US007012581B2

(12) United States Patent
Ueda et al.

(10) Patent No.: US 7,012,581 B2
(45) Date of Patent: Mar. 14, 2006

(54) PLASMA DISPLAY PANEL

(75) Inventors: Kentaro Ueda, Tokyo (JP); Toshiyuki Akiyama, Tokyo (JP); Yasutaka Tsutsui, Tokyo (JP)

(73) Assignee: Pioneer Corporation, Tokyo (JP)

( * ) Notice: Subject to any disclaimer, the term of this patent is extended or adjusted under 35 U.S.C. 154(b) by 366 days.

(21) Appl. No.: 10/632,838

(22) Filed: Aug. 4, 2003

(65) Prior Publication Data

US 2004/0056826 A1 Mar. 25, 2004

(30) Foreign Application Priority Data

Aug. 2, 2002 (JP) ..... 2002-225890
Jul. 30, 2003 (JP) ..... 2003-282649

(51) Int. Cl.
*G09G 3/28* (2006.01)

(52) U.S. Cl. ..... 345/62; 345/60; 315/169.4

(58) Field of Classification Search ..... 345/60, 345/62, 63, 66–68; 315/169.1, 169.4
See application file for complete search history.

(56) References Cited

U.S. PATENT DOCUMENTS 6,384,532 B1 * 5/2002 Yoshioka et al. ..... 313/586
2001/0054872 A1 * 12/2001 Okigawa et al. ..... 313/586
2002/0140341 A1 * 10/2002 Nishio ..... 313/491
2003/0048240 A1 * 3/2003 Shin et al. ..... 345/60

FOREIGN PATENT DOCUMENTS

JP 11-67100 A 3/1999
JP 2001-236889 A 8/2001

OTHER PUBLICATIONS

Kosugi et al., "Reduction of background emission at the set-up period of AC-PDP using ramp waveform", Technical Report of IEICE, EID98-95, Jan. 1999, pp. 91-96, with English Abstract.

* cited by examiner

*Primary Examiner*—Ricardo Osorio
*Assistant Examiner*—Mansour M. Said
(74) *Attorney, Agent, or Firm*—Sughrue Mion, PLLC

(57) ABSTRACT

A plasma display panel includes a first substrate, a second substrate spaced away from the first substrate, scanning and sustaining electrodes formed on the first substrate and extending in a first direction, a dielectric layer formed on the first substrate, covering the scanning and sustaining electrodes therewith, and a data electrode formed on the second substrate and extending in a second direction perpendicular to the first direction, each of the scanning and sustaining electrodes being comprised of a transparent electrode, the dielectric layer being comprised of a transparent dielectric layer, the dielectric layer having a high-capacity portion having a capacity higher than that of the rest of the dielectric layer, the high-capacity portion being spaced away from a discharge gap and extending in the first direction, each of the scanning and sustaining electrodes being formed with an opening between the discharge gap and the high-capacity portion.

19 Claims, 10 Drawing Sheets

PLASMA DISPLAY PANEL

BACKGROUND OF THE INVENTION

1. Field of the Invention

The invention relates to a plasma display panel, and more particularly to a plasma display panel capable of enhancing a discharge efficiency.

2. Description of the Related Art

A plasma display panel is structurally grouped into a DC type plasma display panel in which electrodes are exposed to a discharge gas space and which operates in DC discharge condition, and an AC type plasma display panel in which electrodes are covered with a dielectric layer and which operates indirect AC discharge condition. An AC type plasma display panel is predominantly used because it has a longer lifetime and can display images with higher definition.

An AC type plasma display panel is further grouped into a memory operation type panel making use of a memory function of a display cell, and a refresh operation type panel not making use of such a memory function.

A luminance in a plasma display panel is in proportion to the number of discharges.

Since a luminance is reduced, as a display capacity is increased, in a refresh operation type panel, a refresh operation type panel is used as a plasma display panel having a small display capacity.

FIG. 1 is an exploded perspective view of a display cell in a conventional AC type plasma display panel. FIG. 2A is a partial plan view of scanning and sustaining electrodes in the AC type plasma display panel illustrated in FIG. 1, and FIG. 2B is a cross-sectional view taken along the line 2B—2B in FIG. 2A.

In a display cell, there are arranged a first electrically insulating substrate 101 (hereinafter, referred to simply as "first substrate") and a second electrically insulating substrate 102 (hereinafter, referred to simply as "second substrate") both composed of glass. The first substrate 101 will make a rear panel substrate, and the second substrate 102 will make a front panel substrate.

The second substrate 102 is formed on a surface facing the first substrate 101 with transparent electrodes 103 and 104 extending in a first direction (a row direction) in parallel with each other.

Bus electrodes 105 and 106 are formed on the transparent electrodes 103 and 104, respectively. For instance, the bus electrodes 105 and 106 are comprised of a thin CrCu film or a thin Cr film having a thickness of about 1 to 4 $\mu$m. The bus electrodes 105 and 106 reduce a resistance between the transparent electrodes 103 and 104 and external driver circuits.

The transparent electrode 103 and the bus electrode 105 define a scanning electrode 115, and the transparent electrode 104 and the bus electrode 106 define a sustaining electrode 116.

In each of display cells, the bus electrodes 105 and 106 are located remotest from a surface-discharge gap defined between the transparent electrodes 103 and 104.

The transparent electrodes 103 and 104 are covered with a dielectric layer 112, and the dielectric layer 112 is covered with a protection layer 114. The protection layer 114 is composed of magnesium oxide (MgO), for instance, and protects the dielectric layer 112 from discharges.

The first substrate 101 is formed on a surface facing the second substrate 102 with a data electrode 107 extending in a second direction (a column direction) perpendicular to the first direction.

A dielectric layer 113 is formed on the first substrate 101, covering the data electrode 107 therewith. On the dielectric layer 113 is formed a plurality of partition walls 109 extending in the second direction.

A phosphor layer 111 is formed on sidewalls of the partition walls 109 and an exposed surface of the dielectric layer 113. The phosphor layer 111 converts ultra-violet rays generated by discharges, into visible lights 110.

Between the first and second substrate 101 and 102 and further between adjacent partition walls 109 are defined discharge gas spaces 108 filled with discharge gas comprised of helium, neon or xenon alone or in combination.

In the plasma display panel having the above-mentioned structure, when a voltage difference between the scanning electrode 115 and the sustaining electrode 116 is over a threshold voltage, discharge is generated, and accordingly, the visible light 110 is emitted.

FIG. 3 is a timing chart of an operation of the above-mentioned conventional plasma display panel. Hereinbelow is explained an operation of the conventional plasma display panel with reference to FIG. 3.

As illustrated in FIG. 3, a sub-field is comprised of a priming period, an address period, a sustaining period, and a charge-eliminating period arranged in this order.

In the priming period, a serrate priming pulse Ppr-s is applied to the scanning electrode 115, and a rectangular priming pulse Ppr-c is applied to the sustaining electrode 116. The priming pulse Ppr-s is a positive pulse, whereas the priming pulse Ppr-c is a negative pulse.

According to Electronics-Data Communication Academy Technical Report EID98-95, January 1991, pp. 91, a black luminance can be reduced by using a serrate pulse having a voltage gradient of 7.5 V/microsecond or smaller.

The smaller the gradient is, the more significantly a black luminance can be reduced. However, if a voltage gradient is too small, it would take much time for a voltage to reach a threshold voltage at which a priming discharge is generated. As a result, it is unavoidable that the priming period is long, and hence, the sustaining period is short, causing a problem that a peak luminance in sustaining discharge is lowered, and resultingly, a contrast is lowered. Hence, a voltage gradient of about 4 V/microsecond is usually selected.

In the priming period, a voltage of the scanning electrode 115 is varied by means of a ramp pulse having a voltage gradient of 1 to 10 V/microsecond such that the voltage of the scanning electrode 115 becomes positive relative to voltages of the sustaining electrode 116 and the data electrode 107. After the voltage of the scanning electrode 115 has stopped rising, the voltage is then lowered by means of a ramp pulse having a voltage gradient of 1 to 10 V/microsecond. While the voltage is being lowered, a voltage of the sustaining electrode 116 is raised such that the voltage of the sustaining electrode 116 becomes positive relative to the voltage of the scanning electrode 115. The address period follows the priming period, in which whether images are displayed or not is determined for each of display cells, and the sustaining period follows the address period, in which a luminance at which images are displayed is determined.

The application of the priming pulses Ppr-s and Ppr-c causes generation of priming discharge in the discharge gas space 108 in the vicinity of a discharge gap defined between the scanning and sustaining electrodes 115 and 116, and generation of active ions which facilitate generation of subsequent sustaining discharges. Furthermore, negative wall charges are accumulated on the scanning electrode 115, and positive wall charges are accumulated on the data and sustaining electrodes 107 and 116.

Then, a charge-controlling pulse Ppe-s is applied to the scanning electrode 115. As a result, weak discharge is generated, and resultingly, the negative wall charges accumulated on the scanning electrode 115 and positive wall charges accumulated on the data and sustaining electrodes 107 and 116 are reduced. In particular, wall charges existing in the vicinity of a discharge gap defined between the scanning and sustaining electrodes 115 and 116 are eliminated by the charge-controlling pulse Ppe-s.

In the subsequent address period, a discharge cell or discharge cells from a visible light is to be emitted is(are) selected. Writing discharge is generated only in display cells having been selected by a negative scanning pulse Pbw-s or Pw-s applied to the scanning electrode 115 and a positive data pulse Pd applied to the data electrode 107, resulting in that wall charges are accumulated on electrodes in display cells from which a visible light is to be emitted in the following sustaining period.

In a discharge cell or discharge cell in which the writing discharge has been generated, wall charges are accumulated on electrodes in the discharge cell(s). In contrast, in a discharge cell or discharge cells in which the writing discharge has not been generated, the discharge cell(s) remains in a condition identical to a condition found when the prime period has been terminated.

In the following sustaining period, a visible light is emitted from the selected display cell(s).

A negative sustaining pulse Psus-c is first applied to the sustaining electrode 116, and then, a negative sustaining pulse Psus-s is applied to the scanning electrode 115. The sustaining pulses Psus-c and Psus-s are alternately applied to the sustaining and scanning electrodes 116 and 115. Since wall charges having existed in the vicinity of a discharge gap defined between the scanning and sustaining electrodes 115 and 116 are eliminated in display cells in which the writing discharge was not generated, sustaining discharge is not generated in the display cells, even if the sustaining pulses Psus-s and Psus-c were applied to the display cells.

Since positive wall charges are accumulated on the scanning electrode 115 and negative wall charges are accumulated on the sustaining electrode 116 in a display cell or display cells in which the writing discharge was generated in the address period, a voltage of the negative sustaining pulse Psus-c applied to the sustaining electrode 116 and a voltage caused by the wall charges are added to each other. When a voltage across the scanning and sustaining electrode 115 and 116 is over a threshold voltage at which discharge is generated, there is generated strong discharge.

Once discharge is generated, the wall charges are rearranged so as to cancel voltages applied to the electrodes. Accordingly, negative charges are accumulated on the sustaining electrode 116, and positive charges are accumulated on the scanning electrode 115. A positive-voltage pulse is applied to the scanning electrode 115 as the next sustaining pulse. A voltage of the applied pulse and a voltage caused by the wall charges are added to each other, and when an effective voltage applied to the discharge gas space 108 is over the above-mentioned threshold voltage, discharge is generated.

Hereinafter, the same steps as mentioned above are repeatedly carried out, thereby discharges are repeatedly generated accordingly. A luminance is dependent on the number of repetition of the discharges.

In the subsequent charge-eliminating period, a negative serrate pulse Pse-s is applied to the scanning electrode 115. The application of the pulse Pse-s eliminates wall charges accumulated on the electrodes due to light-emission in the previous sub-field, and uniformizes conditions of all of display cells regardless of whether light-emission was accomplished in the previous sub-field.

Japanese Patent Application Publication No. 11-67100 has suggested a plasma display panel including a partition wall arranged in a matrix, and a bus electrode constituting a scanning electrode which bus electrode is located adjacent to a discharge gap for the purpose of reduction in power consumption. FIG. 5 of the Publication shows that a voltage at which discharge is generated between a scanning electrode and a data electrode is lowest when a bus electrode is located at the middle between a discharge gap and a non-discharge gap of a transparent electrode constituting a scanning electrode. Furthermore, FIG. 6 of the Publication shows that a luminance is reduced to a greater degree because a light is shielded by a bus electrode, if the bus electrode is located closer to the discharge gap from the non-discharge gap. Hence, a bus electrode is positioned so as to have a low-voltage effect which would cancel a disadvantage of the reduction in a luminance. A bus electrode constituting a sustaining electrode is located in the vicinity of the non-discharge gap.

FIG. 4 is a plan view of a display cell in a plasma display panel suggested in Japanese Patent Application Publication No. 2001-236889.

As illustrated in FIG. 4, a surface electrode. 125 is comprised of a plurality of thin-line electrodes 121 extending in a row direction and equally spaced away from one another between a discharge gap 122 and a non-discharge gap 123, and thin-line electrodes 124 extending in a column direction and connecting ends of the thin-line electrodes 121 to one another. Thin-line electrodes 124 extending from the surface electrodes 125 in the column direction and bus electrodes 126 extending in a row direction are electrically connected to each other, and make sustaining electrode pairs including a scanning electrode 127 and a common electrode 128.

In the surface electrode 125 illustrated in FIG. 4, the thin-line electrodes 121 at which sustaining discharge is generated and from which a line of electric force for expanding plasma extends are equally spaced away from one another between the discharge gap 122 and the non-discharge gap 123. The surface electrode 125 having such a structure reduces an intensity of electric field in a discharge space while discharge is being generated, in comparison with the electrode having a non-opening structure, illustrated in FIG. 2A.

Xenon (Xe) gas irradiates ultra-violet rays in a de-excitation step. It is known that if a mixture ratio of Xe gas to mother gas is in the range of about 20 to about 30%, an efficiency of excitation of Xe gas is reduced as an intensity of electric field is increased, even if Xe atoms are attempted to be excited by raising an intensity of electric field when discharge is to be generated. In light of such a phenomenon as mentioned above, it is understood that it is effective to reduce an intensity of electric field in a discharge space during discharge is being generated, in order to enhance an efficiency at which ultra-violet rays are generated, and hence, a light-emission efficiency.

Thus, it would be possible to enhance a light-emission efficiency by generating sustaining discharges by means of the surface electrode 125, and resultingly, reduce power consumption. In addition, since the surface electrode 125 does not extend to adjacent display cells, it would be possible to prevent discharges from being wrongly generated and from being wrongly stopped in being generated, both caused by discharge interference among adjacent display cells.

A recent plasma display panel driven in accordance with pulses having a depressed priming waveform illustrated in FIG. 3 is accompanied with a problem that the scanning and sustaining electrodes 115 and 116 illustrated in FIGS. 2A and 2B are likely to cause excessively eliminate wall charges between the scanning and sustaining electrodes 115 and 116 at the latter half of the priming period, and resultingly, subsequent address discharges are difficult in being generated. This problem is caused by that the scanning and sustaining electrodes 115 and 116 continuously extend from a discharge gap which is defined between the scanning and sustaining electrodes 115 and 116 and at which discharge is generated, to a non-discharge gap.

A recent plasma display panel is accompanied further with a problem that preliminary discharge expands fully in the discharge gas space 108, and resultingly, a luminance in displaying solid black raises.

As suggested in the above-mentioned Japanese Patent Application Publication No. 11-67100, by arranging a bus electrode constituting a scanning electrode, at a center between a discharge gap and a non-discharge gap, wall charges are much accumulated on a dielectric layer above the bus electrode and in the vicinity of the discharge gap.

However, since a charge-eliminating discharge generated by a pulse having a depressed priming waveform expands entirely over the electrodes, the wall charges accumulated on the dielectric layer above the bus electrode and in the vicinity of the discharge gap are likely to be eliminated. Elimination of the wall charges causes that address discharge is unlikely to be generated above the bus electrode and in the vicinity of the discharge gap, and hence, address discharge is generated on the transparent electrodes other than the bus electrode. As a result, it would be impossible to smoothly transfer to sustaining discharge from address discharge.

In the plasma display panel suggested in the above-mentioned Japanese Patent Application Publication No. 2001-236889, illustrated in FIG. 4, the above-mentioned problem is not caused, because both of the scanning and sustaining electrodes extend from a discharge gap towards the bus electrodes 126 in a non-continuous pattern.

However, since the bus electrodes 126 are arranged at a non-discharge gap, and address discharge is generated in the vicinity of the bus electrodes 126, wall charges generated in the address discharge are accumulated on and in the vicinity of the bus electrodes 126. Thus, the problem that address discharge is not smoothly transferred to sustaining discharge still remains unsolved.

SUMMARY OF THE INVENTION

In view of the above-mentioned problems in the conventional plasma display panels, it is an object of the present invention to provide a plasma display panel driven in accordance with a pulse having a depressed priming waveform, which is capable of smoothly transferring to sustaining discharge from address discharge Another object of the present invention is to provide a plasma display panel which is capable of smoothly transferring to sustaining discharge from preliminary discharge.

In one aspect of the present invention, there is provided a plasma display panel including (a) a first substrate, (b) a second substrate spaced away from and facing the first substrate, (c) at least one scanning electrode formed on a surface of the first substrate which surface faces the second substrate, and extending in a first direction, (d) at least one sustaining electrode formed on the surface of the first substrate and extending in parallel with the scanning electrode, (e) a dielectric layer formed on the first substrate, covering the scanning and sustaining electrodes therewith, and (f) at least one data electrode formed on a surface of the second substrate which surface faces the first substrate, and extending in a second direction perpendicular to the first direction, display cells being arrange at intersections of the scanning and sustaining electrodes and the data electrode, each of the scanning and sustaining electrodes being comprised of a transparent electrode, the dielectric layer being comprised of a transparent dielectric layer, the dielectric layer having a high-capacity portion having a capacity higher than that of the rest of the dielectric layer, the high-capacity portion being spaced away from a discharge gap and extending in the first direction, each of the scanning and sustaining electrodes being formed with an opening between the discharge gap and the high-capacity portion.

By arranging a high-capacity portion between a discharge gap and a non-discharge gap of a scanning electrode, wall charge are accumulated selectively on the high-capacity portion after generation of priming discharge when a plasma display panel is driven in accordance with a pulse having a depressed priming waveform as illustrated in FIG. 3. In addition, by forming an opening between the discharge gap and the high-capacity portion, most of the wall charges having accumulated selectively on the high-capacity portion remains as they are without being eliminated, because priming-eliminating discharge does not extend beyond the opening. As a result, it is possible to reduce a voltage at which address discharge is generated, and readily generate address discharge. Furthermore, since address discharge is generated in the vicinity of the discharge gap, address discharge would be smoothly transferred to sustaining discharge.

In order to enhance a light-emission luminance and a light-emission efficiency of a plasma display panel, it is not always necessary to generate plasma uniformly all over a display cell at a high density. What is important is not to expand plasma caused by sustaining discharge, to a display cell at entirety, but to efficiently generate ultra-violet rays and efficiently irradiate the thus generated ultra-violet rays to a phosphor layer for generation of a visible light. Accordingly, in order to enhance a light-emission efficiency, it would be effective to form small sustaining-discharge regions all over a display cell in spatially and time-sequentially separation to thereby weaken electric field applied to a discharge gas space and prevent reduction in an efficiency at which ultra-violet rays are generated. In accordance with the present invention, an opening is formed in the scanning and sustaining electrodes for partially weakening electric field.

Each of the scanning and sustaining electrodes may be formed with a second opening at an opposite side of the discharge gap about the high-capacity portion.

By forming a second opening as well as the above-mentioned opening, it would be possible to prevent priming-eliminating discharge from expanding, ensuring that a voltage at which address discharge is generated is lowered, and hence, address discharge can be readily generated.

By designing the opening and the second opening to have an appropriate length in the second direction and arranging an electrode between the opening and the second opening, sustaining discharge generated by applying a rectangular pulse to the sustaining electrode can expand beyond the opening. Thus, it would be possible to generate sustaining discharge and expand plasma all over a display cell by means of a sustaining electrode having a minimum area, ensuring enhancement of a light-emission efficiency without reduction in a light-emission luminance.

If the opening were too long in the second direction, sustaining discharge cannot extend beyond the opening. By arranging in the second direction at least two openings each having a maximum length over which sustaining discharge can extend, a light-emission efficiency can be enhanced.

The number of the opening and the second opening is not to be limited to one. Two or more openings and second openings may be arranged.

The opening and the second opening may be different in shape from each other. As an alternative, the opening and the second opening may be substantially identical in shape to each other. For instance, the opening and the second opening may be rectangular in shape in the same size.

It is preferable that the opening is located in symmetry with the second opening about the bus electrode.

The high-capacity portion may have a thickness smaller than a thickness of the rest of the dielectric film.

By designing a portion of a dielectric layer to have a thickness smaller than a thickness of the rest of the dielectric layer, the portion would have a capacity greater than a capacity of the rest of the dielectric layer.

It is preferable that the scanning and sustaining electrodes are formed separately in each of the display cells, and are electrically connected to one another, respectively, through a bus electrode extending in the first direction, and the high-capacity portion is formed above the bus electrode.

By arranging the scanning and sustaining electrodes separately in each of display cells, principal discharge is unlikely to expand to adjacent display cells, and hence, it would be possible to prevent discharge interference among adjacent display cells. In addition, by spacing the scanning and sustaining electrodes away from the partition wall, it would be possible to reduce power loss at the partition wall.

The high-capacity portion is formed above the bus electrode. The dielectric layer is formed by the steps of coating glass paste having a low fusing point, onto the scanning and sustaining electrodes, and baking them at about 600 degrees centigrade. The resultant dielectric layer is comprised of a transparent layer having a thickness in the range of 20 to 40 micrometers. At a portion of the dielectric layer on which the scanning and sustaining electrodes and a bus electrode having a thickness of about 10 micrometers are formed, the dielectric layer has a reduced thickness. That is, by forming the dielectric layer through the use of the glass paste, the dielectric layer formed above the bus electrode inevitably define the high-capacity portion.

The bus electrode may be designed to have a width smaller than a width of the scanning and sustaining electrodes.

The bus electrode may be designed to pass a center of the scanning and sustaining electrodes in the second direction.

It is preferable that the bus electrode is located at a distance in the range of 120 $\mu$m and 300 $\mu$m both inclusive from a centerline of the discharge gap.

The high-capacity portion may be comprised of a dielectric layer having a dielectric constant higher than that of the rest of the dielectric layer.

For instance, by forming a portion of the dielectric layer of dielectric substance having a dielectric constant higher than a dielectric constant of the rest of the dielectric layer, the portion will make a high-capacity portion.

It is preferable that the scanning and sustaining electrodes are formed separately in each of the display cells, and are electrically connected to one another, respectively, through a bus electrode extending in the first direction above non-discharge gaps, that is, ends of the scanning and sustaining electrodes which end is located remote from the discharge gap.

As an alternative, the bus electrode may be designed to include a first bus electrode formed above the high-capacity portion and extending in the first direction, and a second bus electrode extending in the first direction above ends of the scanning and sustaining electrodes which end is located remote from the discharge gap.

The scanning and sustaining electrodes may be connected to each other, respectively, across adjacent display cells in the first direction.

It is preferable that the opening and/or the second opening have(has) a shape of a rectangle having sides each having a length equal to or greater than 50 $\mu$m.

It is preferable that the high-capacity portion passes centers of the scanning and sustaining electrodes in the second direction.

The plasma display panel in accordance with the present invention may be driven in accordance with the following drive sequence.

A drive voltage increasing with the lapse of time is applied to the scanning electrode in a priming period in which a serrate priming pulse which is positive relative to the sustaining electrode is applied to the scanning electrode, and a serrate priming pulse negative relative to the scanning electrode is applied to the sustaining electrode.

The drive sequence may have, in an order, (a) a priming period in which a voltage of the scanning electrode is raised by means of a pulse having a ramp waveform positive relative to the sustaining and data electrodes, the voltage is lowered by means of a pulse having a ramp waveform negative relative to the sustaining and data electrodes after the voltage is stopped being raised, and a voltage of the sustaining electrode is raised in such a manner that a voltage of the sustaining electrode is positive relative to a voltage of the scanning electrode while the voltage is being lowered, (b) an address period in which whether a light is emitted or not for each of the display cells, and (c) a sustaining discharge period in which a luminance is determined.

In another aspect of the present invention, there is provided a plasma display apparatus including an analog interface which converts a received analog image signal into a digital image signal, and outputs the thus converted digital image signal, and a plasma display module which includes the above-mentioned plasma display panel, and outputs images in accordance with the digital image signal received from the analog interface.

The advantages obtained by the aforementioned present invention will be described hereinbelow.

In the plasma display panel in accordance with the present invention, the high-capacity portion extending in the first direction is formed in the dielectric layer at the centers of the scanning and sustaining electrodes, and the scanning and sustaining electrodes are formed with an opening extending from a discharge gap to the high-capacity portion, ensuring it possible to generate discharge at the high-capacity portion located remote from the discharge gap, at a low voltage and in a short period of time.

By relatively weakening electric field in the vicinity of the discharge gap, energy which exceeded threshold energy necessary for irradiation of Xe molecular beam and Xe resonance line can be lowered, thereby improving a light-emission efficiency. In particular, when discharge gas containing Xe gas having an increased partial pressure is used, discharge tends to be generated around a discharge gap because of reduction in mobility of Xe gas. However, by forming the opening in which electric field is partially weak, an area in which sustaining discharges are generated may be spatially divided into a plurality of areas, and hence, it would be possible to broadly distribute the resultant plasma. As a result, it would be possible to prevent surface discharge from shrinking, ensuring enhancement in a light-emission efficiency.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Preferred embodiments in accordance with the present invention will be explained hereinbelow with reference to drawings. In the plasma display panels in accordance with the embodiments explained hereinbelow, a priming pulse having a depressed waveform in which a voltage is increased with the lapse of time is applied to a scanning electrode in a priming period, when driven, similarly to the conventional plasma display panel.

[First Embodiment]

Figure 5:
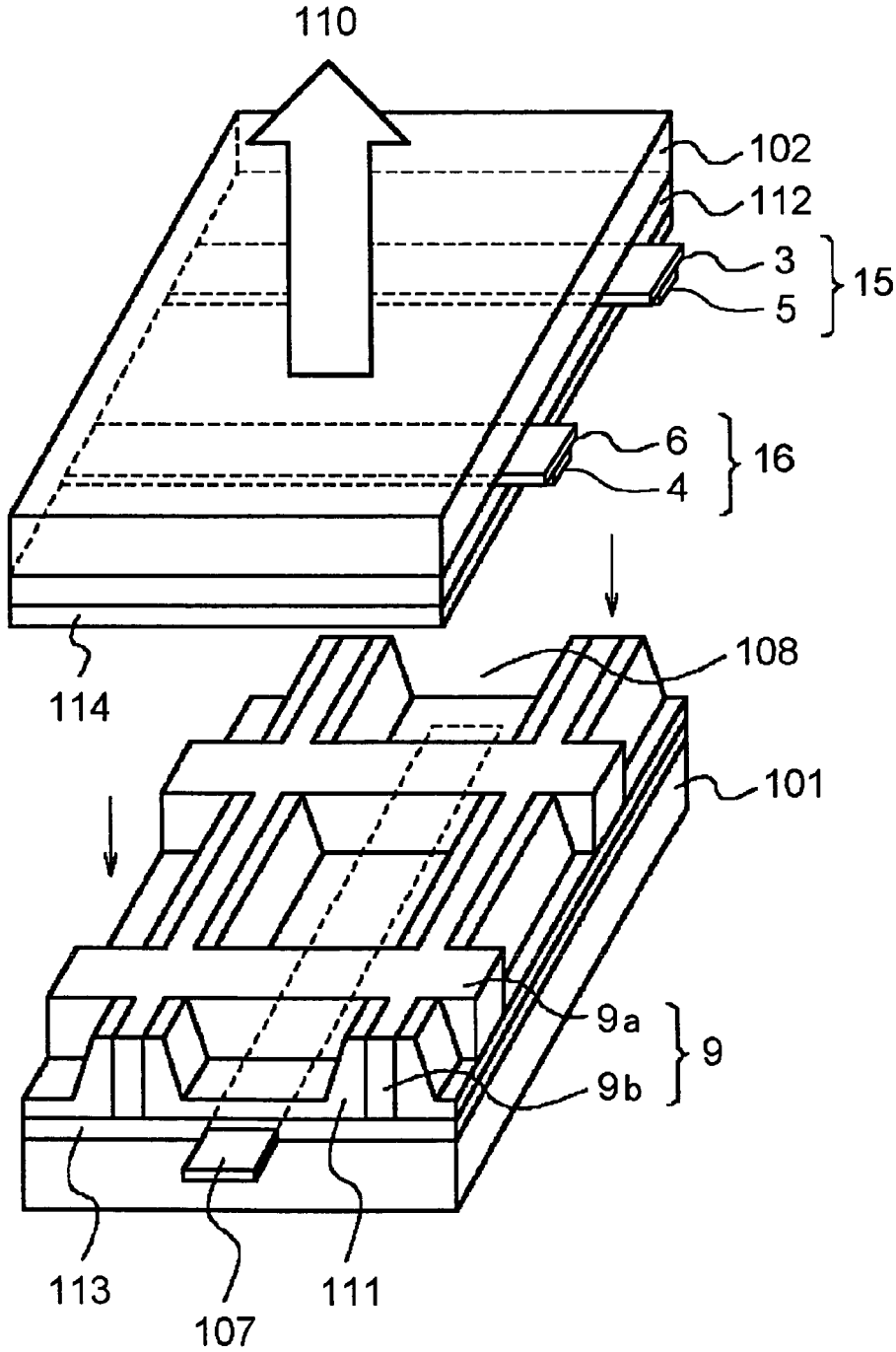
FIG. 5 is a perspective view of a plasma display panel in accordance with the first embodiment of the present invention.
Figure 6A:
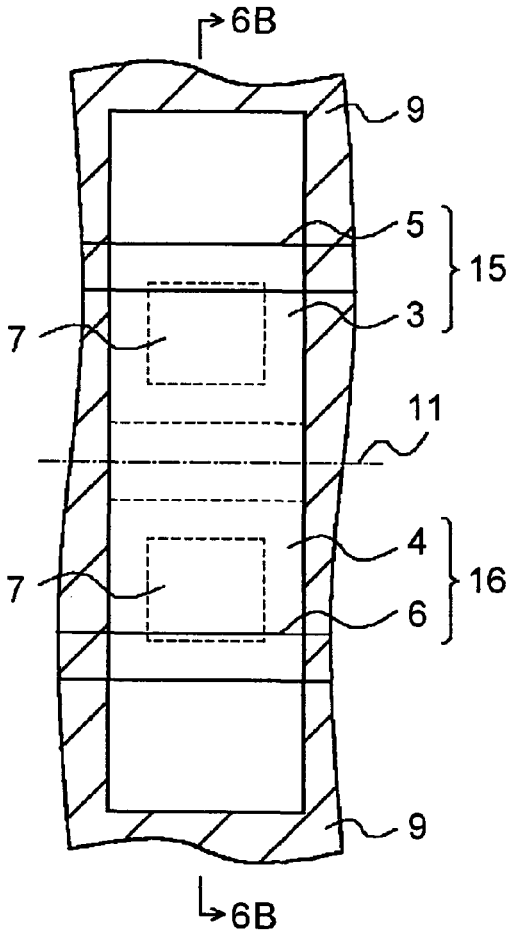
FIG. 6A is a plan view of the plasma display panel illustrated in FIG. 5.

FIG. 5 is a perspective view of a display cell in the plasma display panel in accordance with the first embodiment. FIG. 6A is a plan view of scanning and sustaining electrodes partially constituting the plasma display panel in accordance with the first embodiment, and FIG. 6B is a cross-sectional view taken along the line 6B—6B in FIG. 6A.

Figure 1:
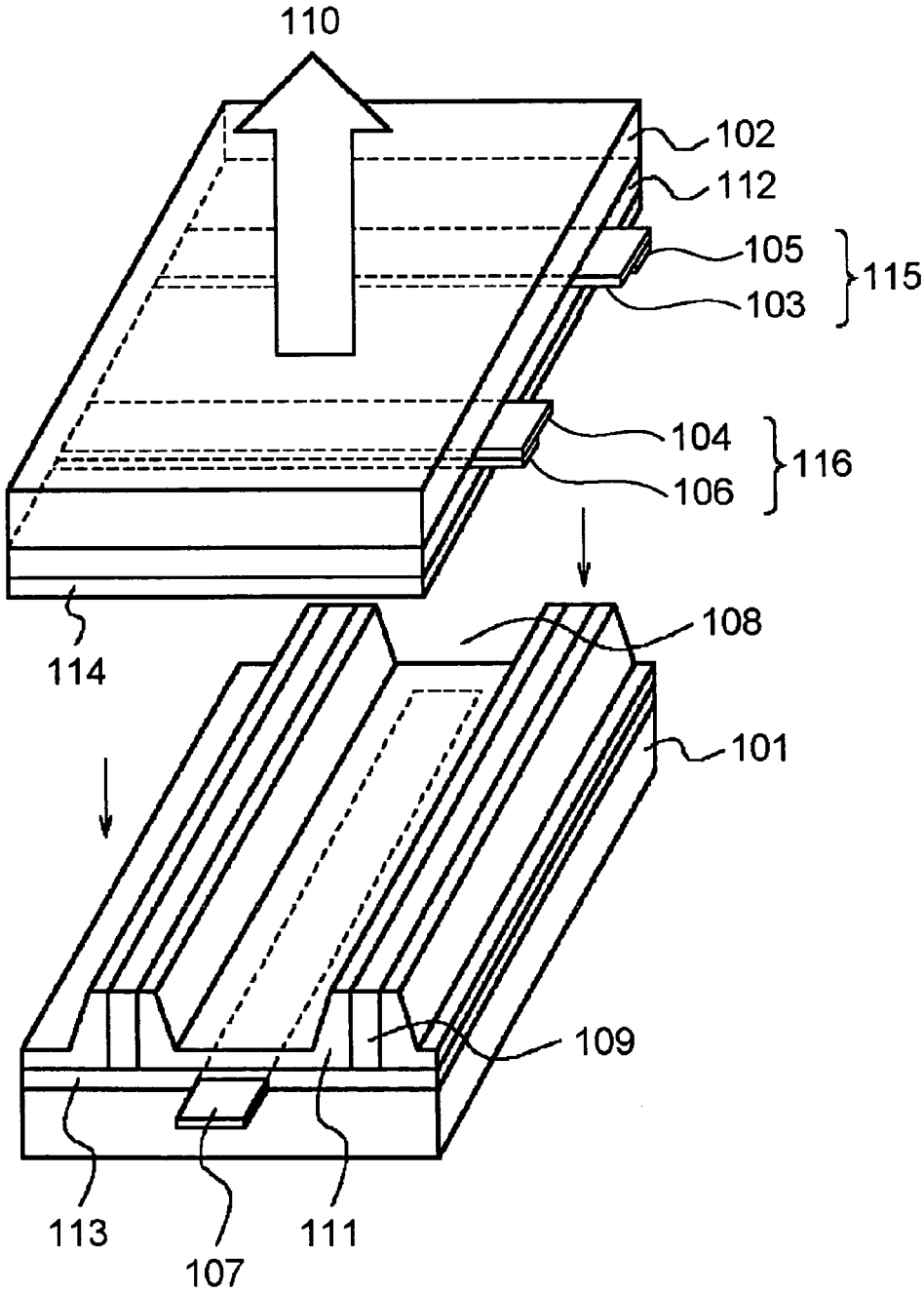
FIG.1 PRIOR ART
FIG. 1 is a perspective view of a conventional plasma display panel
Figure 2A:
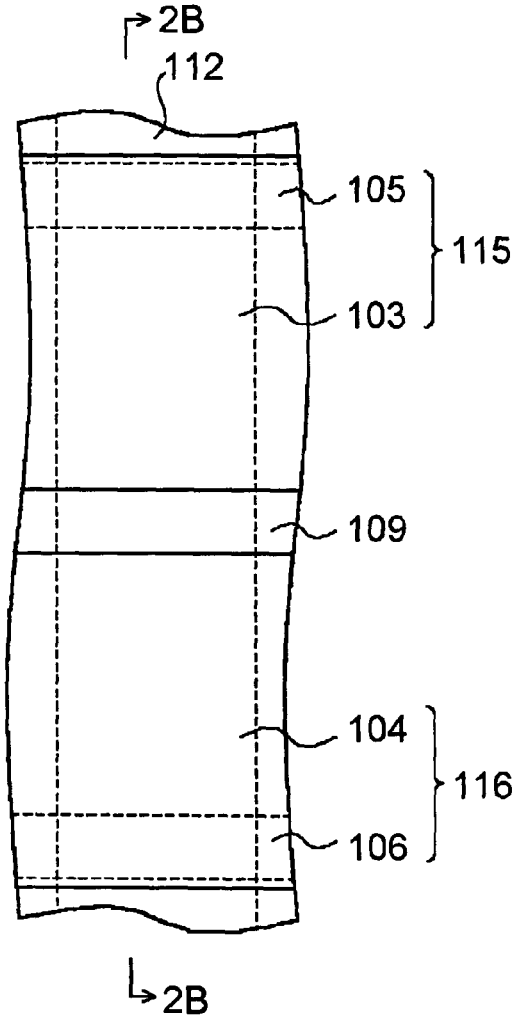
FIG.2A PRIOR ART
FIG. 2A is a plan view of the conventional plasma display panel illustrated in FIG. 1.
Figure 2B:
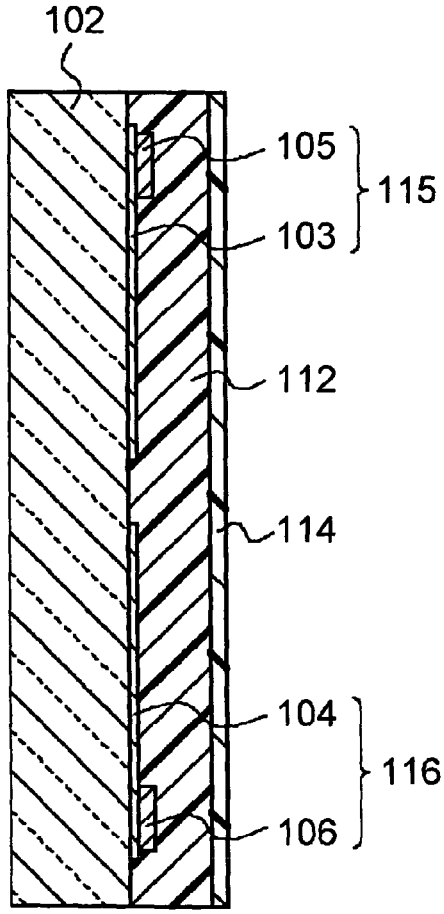
FIG.2B PRIOR ART
FIG. 2B is a cross-sectional view taken along the line 2B—2B in FIG. 2A.

Parts or elements that correspond to those of the conventional plasma display panel illustrated in FIGS. 1, 2A and 2B have been provided with the same reference numerals, and will not be explained.

Figure 6B:
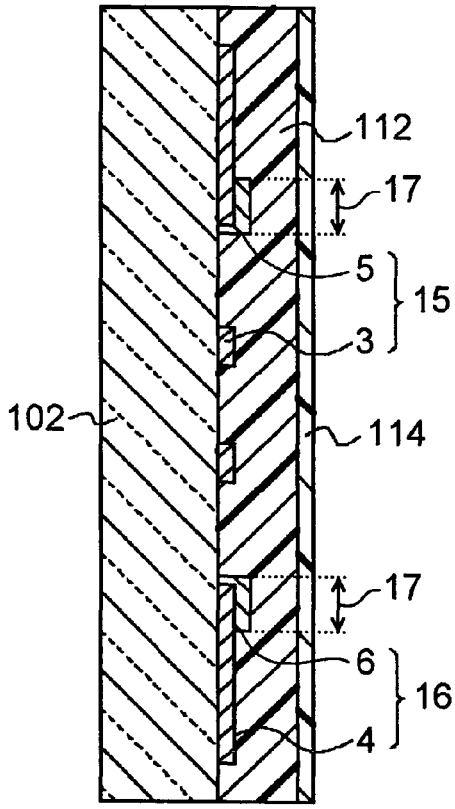
FIG. 6B is a cross-sectional view taken along the line 6B—6B in FIG. 6A.

The plasma display panel in accordance with the first embodiment is structurally different from the conventional plasma display panel illustrated in FIGS. 5, 6A and 6B only with respect to a partition wall, a bus electrode, a scanning electrode and a sustaining electrode.

The plasma display panel in accordance with the first embodiment is designed to include a partition wall 9 in place of the strip-shaped partition wall 109 partially constituting the conventional plasma display panel. The partition wall 9 is comprised of first partition walls 9*a* extending in a first direction (row direction) and second partition walls 9*b* extending in a second direction (column direction) perpendicular to the first direction, and hence, partitions a display cells in a matrix. Hence, each of display cells in the first embodiment is spatially isolated from adjacent display cells.

Each of scanning and sustaining electrodes 15 and 16 is comprised of a transparent electrode. As illustrated in FIG. 6A, bus electrodes 5 and 6 extend in the first direction, passing centers of the scanning and sustaining electrodes 15 and 16 in the second direction.

Each of the scanning and sustaining electrodes 15 and 16 is formed with a rectangular opening 7 between a discharge gap and the bus electrodes 5 and 6, respectively. In FIG. 6A, only a centerline 11 of the discharge gap extending in the first direction is illustrated.

Hereinbelow are explained shapes of the scanning and sustaining electrodes 15 and 16.

The bus electrodes 5 and 6 are spaced away from the centerline 11 of the discharge gap by a distance in the range of 120 to 130 micrometers, and pass centers of transparent electrodes 3 and 4 partially constituting the scanning and sustaining electrodes 15 and 16, respectively.

The opening 7 in which the transparent electrodes 3 and 4 do not exist is in the form of a rectangle having a side equal to or greater than 50 micrometers. The bus electrodes 5, 6 and the transparent electrodes 3, 4 are covered with the dielectric layer 112. The dielectric layer 112 is covered with the protection layer 114 composed of magnesium oxide and protecting the dielectric layer 112 from discharges.

For instance, the bus electrodes 5 and 6 may be designed to have a multi-layered structure including a thin white Ag film and a thin black $RuO_2$ film, and have a thickness of about 7 micrometers.

The transparent electrode 3 and the bus electrode 5 define the scanning electrode 15, and the transparent electrode 4 and the bus electrode 6 define the sustaining electrode 16.

In a display cell, the bus electrodes 5 and 6 are almost centered between a discharge gap and non-discharge gaps of the transparent electrodes 3 and 4. Herein, a non-discharge gap is defined as a region located outside an end of each of the scanning and sustaining electrodes 15 and 16 which end is located oppositely to the discharge gap about the bus electrodes 5 and 6, respectively.

By overlapping the bus electrodes 5, 6 on the transparent electrodes 3, 4, the dielectric layer 112 has a first thickness on the bus electrodes 5, 6 and a second thickness on the transparent electrodes 3, 4 wherein the first thickness is smaller than the second thickness, and resultingly, the dielectric layer 112 would have a first capacity on the bus electrodes 5, 6 and a second capacity on the transparent electrodes 3, 4 wherein the first capacity is greater than the second capacity. Namely, a high-capacity portion 17 can be formed above each of the bus electrodes 5 and 6.

Whereas priming discharge expands entirely in a display cell in the conventional plasma display panel, priming discharge expands in a half area of a display cell closer to a discharge gap in the plasma display panel in accordance with the first embodiment.

The scanning and sustaining electrodes 15 and 16 have a certain area in the vicinity of a discharge gap in order to control discharges, and the high-capacity portion 17 defined as a thinner portion of the dielectric layer 112 is positioned so as to generate discharge at a low voltage and in a short period of time in an area away from the discharge gap. Since the opening 7 is formed between the discharge gap and the high-capacity portion 17, it would be possible to prevent surface discharges from shrinking, and enhance a light-emission efficiency and discharge controllability.

[Second Embodiment]

Figure 7A:
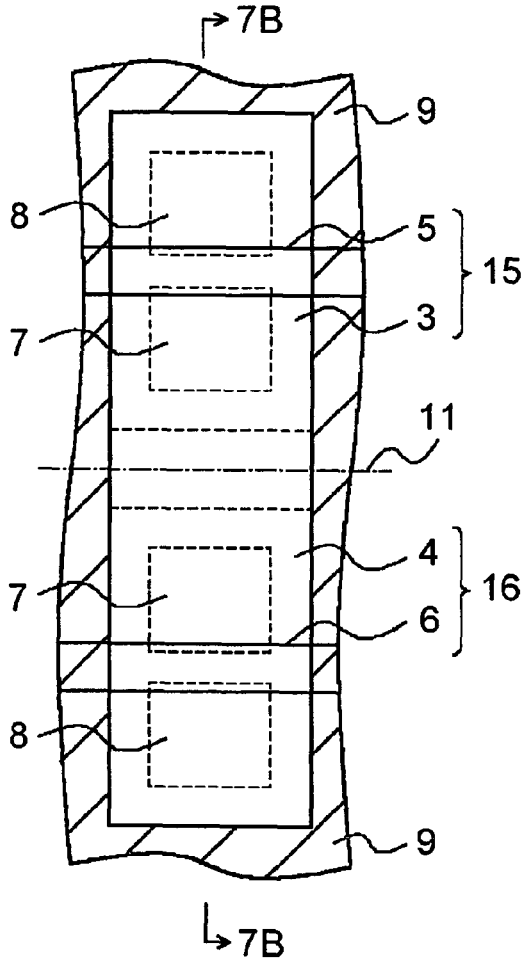
FIG. 7A is a plan view of a plasma display panel in accordance with the second embodiment of the present invention.

Hereinbelow is explained a plasma display panel in accordance with the second embodiment. FIG. 7A is a plan view of scanning and sustaining electrodes partially constituting the plasma display panel in accordance with the second embodiment, and FIG. 7B is a cross-sectional view taken along the line 7B—7B in FIG. 7A.

The plasma display panel in accordance with the second embodiment is structurally different from the plasma display panel in accordance with the first embodiment in further including a second opening 8 in each of the scanning and sustaining electrodes 15 and 16.

Figure 7B:
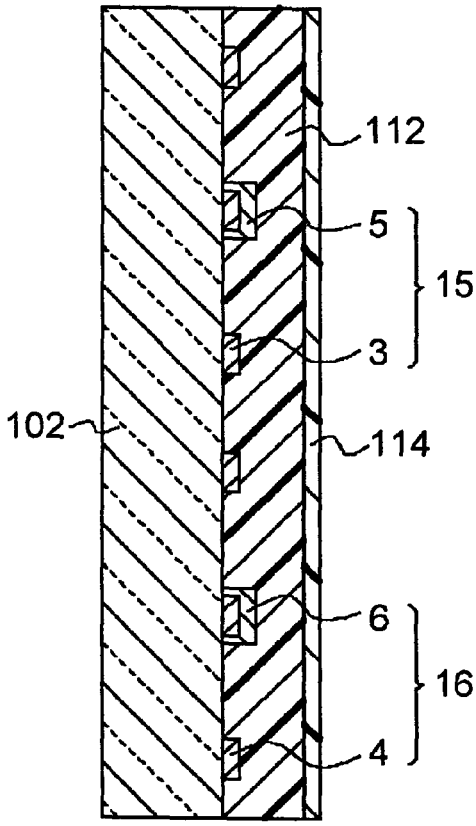
FIG. 7B is a cross-sectional view taken along the line 7B—7B in FIG. 7A.

As illustrated in FIGS. 7A and 7B, the second opening 8 is formed in the scanning and sustaining electrodes 15 and 16 at the opposite side of the discharge gap about the high-capacity portion 17.

The opening 7 and the second opening 8 are located in symmetry with each other about the bus electrodes 5 and 6, and have the same rectangular shape.

By forming the second opening 8 as well as the opening 7, it would be possible to prevent expansion of discharge for eliminating priming discharge, and lower a voltage at which address discharge is generated, facilitating generation of address discharge.

By arranging the opening 7 and the second opening 8 across the bus electrodes 5 and 6, sustaining discharge can expand beyond the openings 7 and 8. Thus, it would be possible to generate sustaining discharge and expand plasma all over a display cell by means of a sustaining electrode having a minimum area, ensuring enhancement of a light-emission efficiency without reduction in a light-emission luminance.

It is not always necessary for the opening 7 and the second opening 8 to have the same shape. They may be different in shape from each other.

The number of the opening 7 and the second opening 8 is not to be limited to one. Two or more openings 7 and second openings 8 may be arranged. For instance, a plurality of the openings 7 and a plurality of the second openings 8 may be arranged in the first or second direction. As an alternative, a plurality of the openings 7 or second openings 8 may be arranged in a matrix.

[Third Embodiment]

Figure 8A:
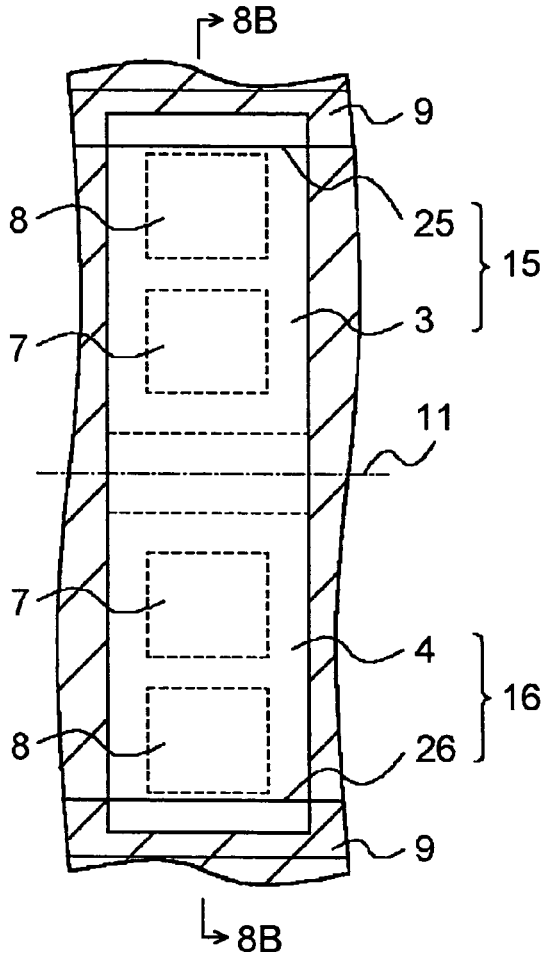
FIG. 8A is a plan view of a plasma display panel in accordance with the third embodiment of the present invention.
Figure 8B:
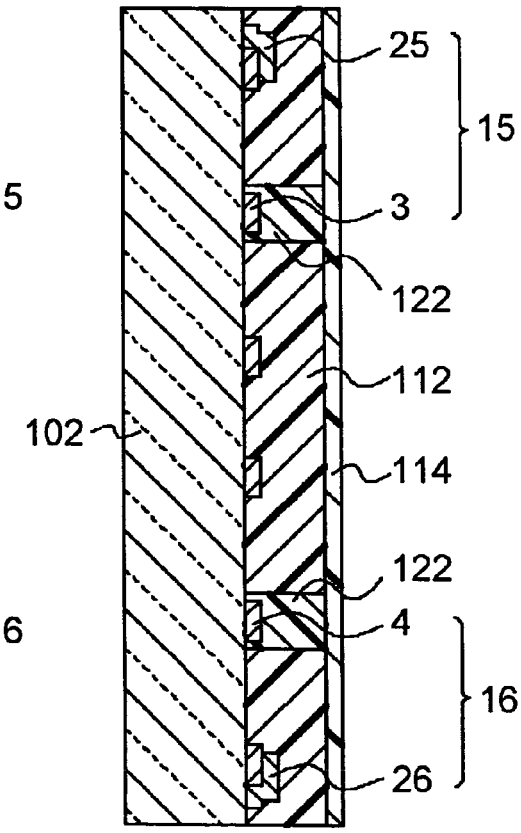
FIG. 8B is a cross-sectional view taken along the line 8B—8B in FIG. 8A.

Hereinbelow is explained a plasma display panel in accordance with the third embodiment. FIG. 8A is a plan view of scanning and sustaining electrodes partially constituting the plasma display panel in accordance with the third embodiment, and FIG. 8B is a cross-sectional view taken along the line 8B—8B in FIG. 8A.

The plasma display panel in accordance with the third embodiment is structurally different from the plasma display panel in accordance with the second embodiment only in location of the bus electrodes 5 and 6, and a structure of the high-capacity portion 17.

Specifically, whereas the high-capacity portion 17 is comprised of a thinner portion of the dielectric layer 112 in the first embodiment, a high-capacity portion 122 in the third embodiment is composed of dielectric substance having a high dielectric constant.

In addition, as illustrated in FIG. 8A, bus electrodes 25 and 26 overlap non-discharge gaps of the transparent electrodes 3 and 4, that is, outer ends of the transparent electrodes 3 and 4 located at the opposite side of the discharge gap about the opening 7 and the second opening 8, and extend in the first direction in parallel with each other.

A portion 122 of the dielectric layer 112 located on a central area of the transparent electrodes 3 and 4 in the second direction, that is, an area sandwiched between the opening 7 and the second opening 8 is composed of dielectric substance having a dielectric constant higher than a dielectric constant of the rest of the dielectric layer 112. Hence, the portion 122 defines a high-capacity portion in the third embodiment.

Since the scanning and sustaining electrodes 15 and 16 are formed with the opening 7 between the discharge gap and the high-capacity portion 122, it would be possible to prevent surface discharge from shrinking, and enhance a light-emission efficiency and discharge controllability.

In addition, since the bus electrodes 25 and 26 are arranged on the non-discharge gaps of the transparent electrodes 3 and 4, it would be possible to have a luminance in light-emission which is higher than a luminance provided in the first embodiment.

Figure 3:
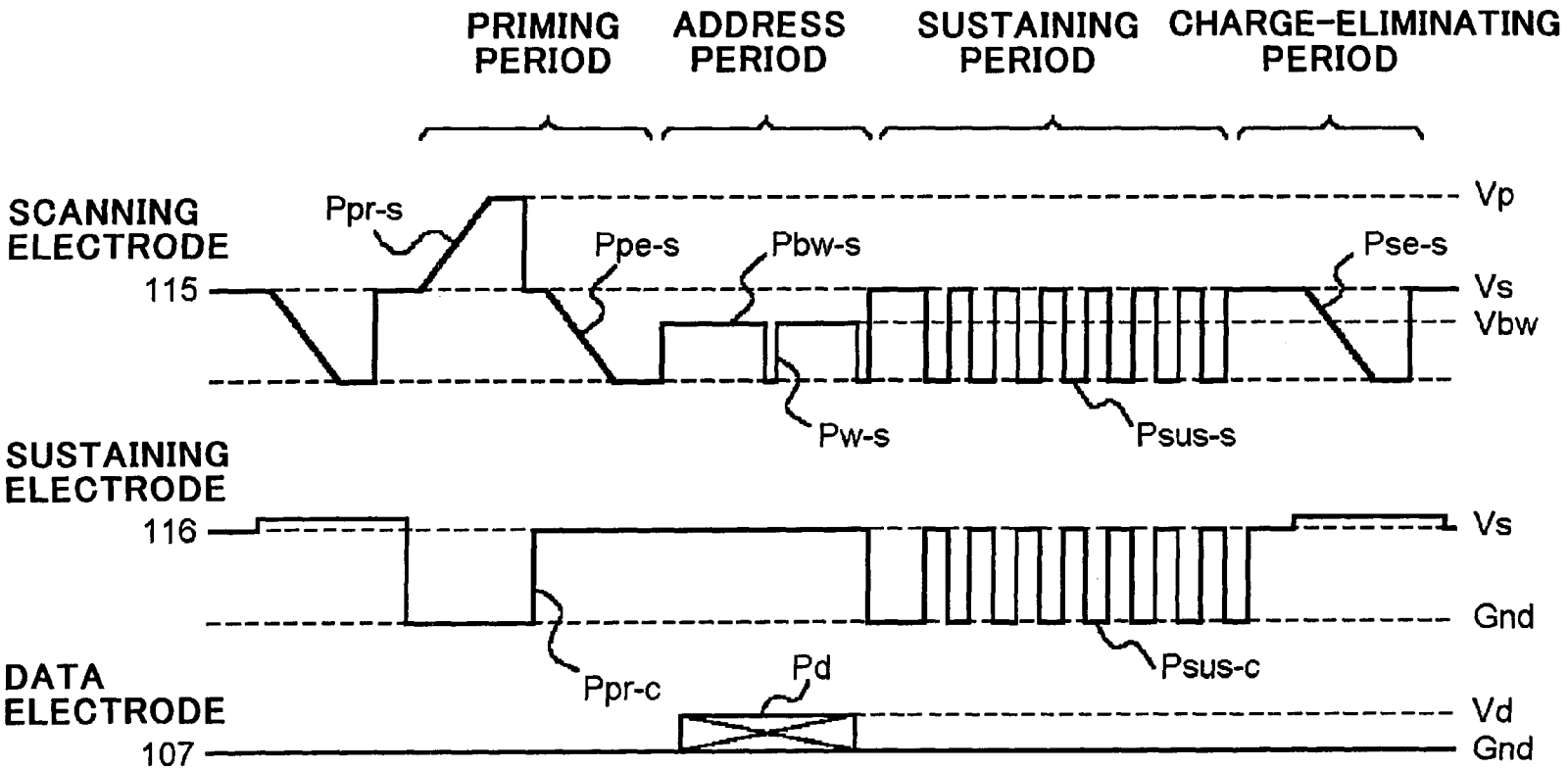
FIG.3 PRIOR ART
FIG. 3 is a timing chart showing waveforms of pulses to be applied to electrodes in the conventional plasma display panel illustrated in FIG. 1.
Figure 4:
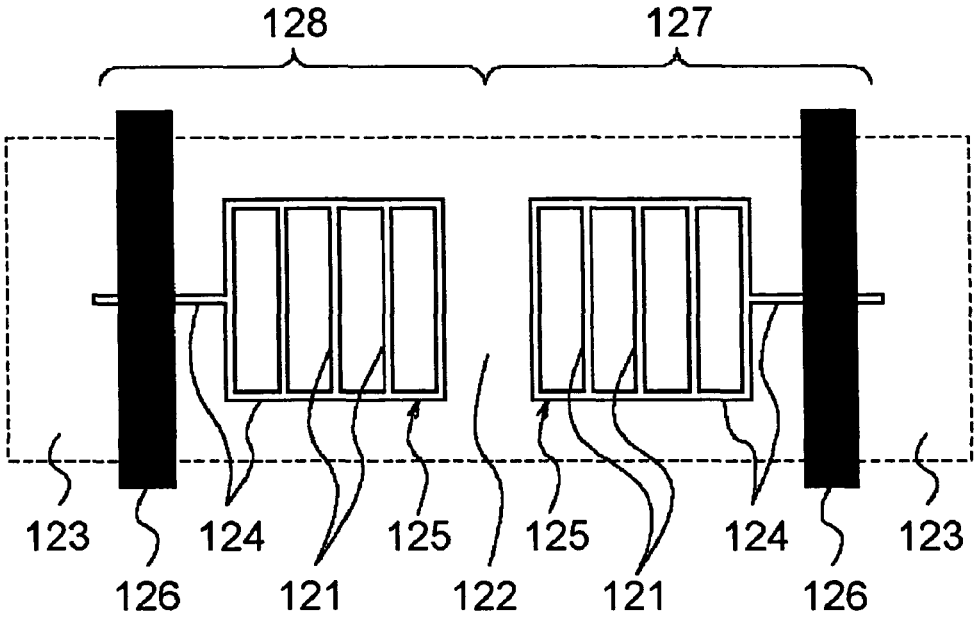
FIG.4 PRIOR ART
FIG. 4 is a plan view of another conventional plasma display panel.

By arranging the high-capacity portion 122 at the middle between the discharge gap and the non-discharge gaps of the scanning and sustaining electrodes 15 and 16, wall charges are accumulated selectively on the high-capacity portion 122 after generation of priming discharge in the case that the plasma display panel is driven in accordance with pulses having a depressed priming waveform as illustrated in FIG. 3.

Since the charge-eliminating discharge is stopped at the opening 7, it would be possible for wall charges to selectively remain on the high-capacity portion 122 by forming the opening 7 in the transparent electrodes 3 and 4. This ensures that a voltage at which writing discharge is generated is lowered, and discharge delay in writing discharge can be shortened.

[Fourth Embodiment]

Figure 9A:
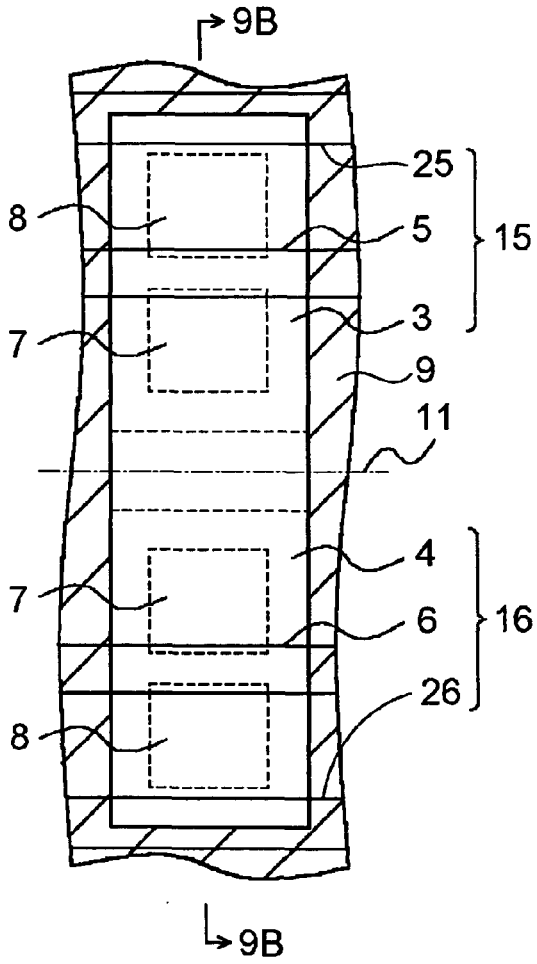
FIG. 9A is a plan view of a plasma display panel in accordance with the fourth embodiment of the present invention.
Figure 9B:
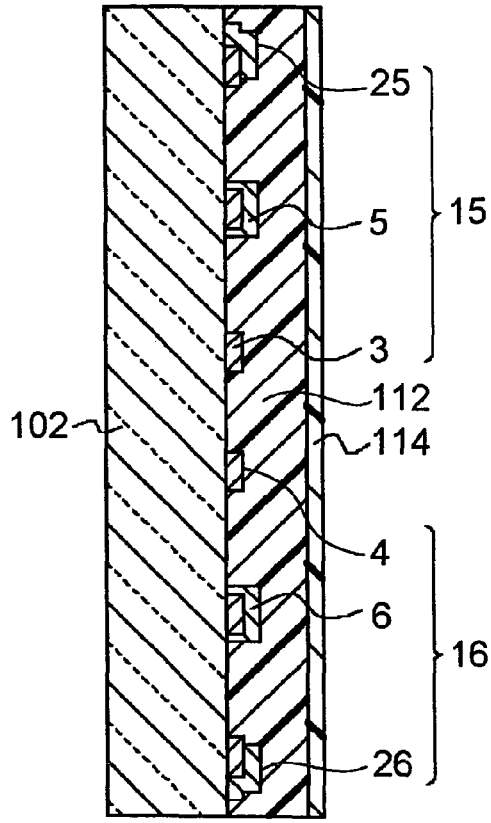
FIG. 9B is a cross-sectional view taken along the line 9B—9B in FIG. 9A.

Hereinbelow is explained a plasma display panel in accordance with the fourth embodiment. FIG. 9A is a plan view of scanning and sustaining electrodes partially constituting the plasma display panel in accordance with the fourth embodiment, and FIG. 9B is a cross-sectional view taken along the line 9B—9B in FIG. 9A.

The scanning and sustaining electrodes 15 and 16 are designed to include the bus electrodes 5 and 6 in the second embodiment, illustrated in FIGS. 7A and 7B, and the bus electrodes 25 and 26 in the third embodiment, illustrated in FIGS. 8A and 8B.

If the scanning and sustaining electrodes 15 and 16 are designed to include one bus electrode 5, 6 or 25, 26 as explained in the second and third embodiments, a resistance of the bus electrodes 5, 6 or 25, 26 cause a voltage drop with the result of non-uniformity of a voltage in a display area, and hence, defectiveness in voltage characteristic. As a solution to this problem, the scanning electrode 15 may be designed to have an increased width for reducing a resistance. However, since the bus electrodes are located in a display area, if the scanning electrode 15 would have an increased width, an aperture ratio would be lowered, and resultingly, a luminance would be reduced.

By arranging the bus electrodes 25 and 26 on the non-discharge gaps as well as the bus electrodes 5 and 6 passing the centers of the scanning and sustaining electrodes 15 and 16 in the second direction, in other words, by designing the scanning and sustaining electrodes 15 and 16 to include the bus electrodes 5, 25 and 6, 26, respectively, it would be possible to lower a resistance of each of the bus electrodes, preventing non-uniformity of a voltage.

In addition, since the bus electrodes 25 and 26 are arranged at an end of a display cell, an aperture ratio and hence a luminance would not be reduced.

Though the plasma display panels in accordance with the above-mentioned embodiments include the partition wall 9 arranged in a matrix, they may include a stripe-shaped partition wall or a partition wall having other shapes.

In the above-mentioned embodiments, the scanning and sustaining electrodes 15 and 16 are arranged separately in each of display cells, and are electrically connected to each other through the bus electrodes 5, 6 or 25, 26 extending in the first direction. As an alternative, the scanning and sustaining electrodes 15 and 16 may be designed to be connected to each other across adjacent display cells in the first direction, and electrically connected to each other through the bus electrodes extending in the first direction.

It is not always necessary for the scanning and sustaining electrodes 15 and 16 to be connected to each other in entire width thereof. They may be connected to each other in a partial width thereof, which ensures advantages provided by separation of the scanning and sustaining electrodes 15 and 16 in each of display cells, and makes it easy to fabricate the scanning and sustaining electrodes 15 and 16.

[Fifth Embodiment]

Figure 10:
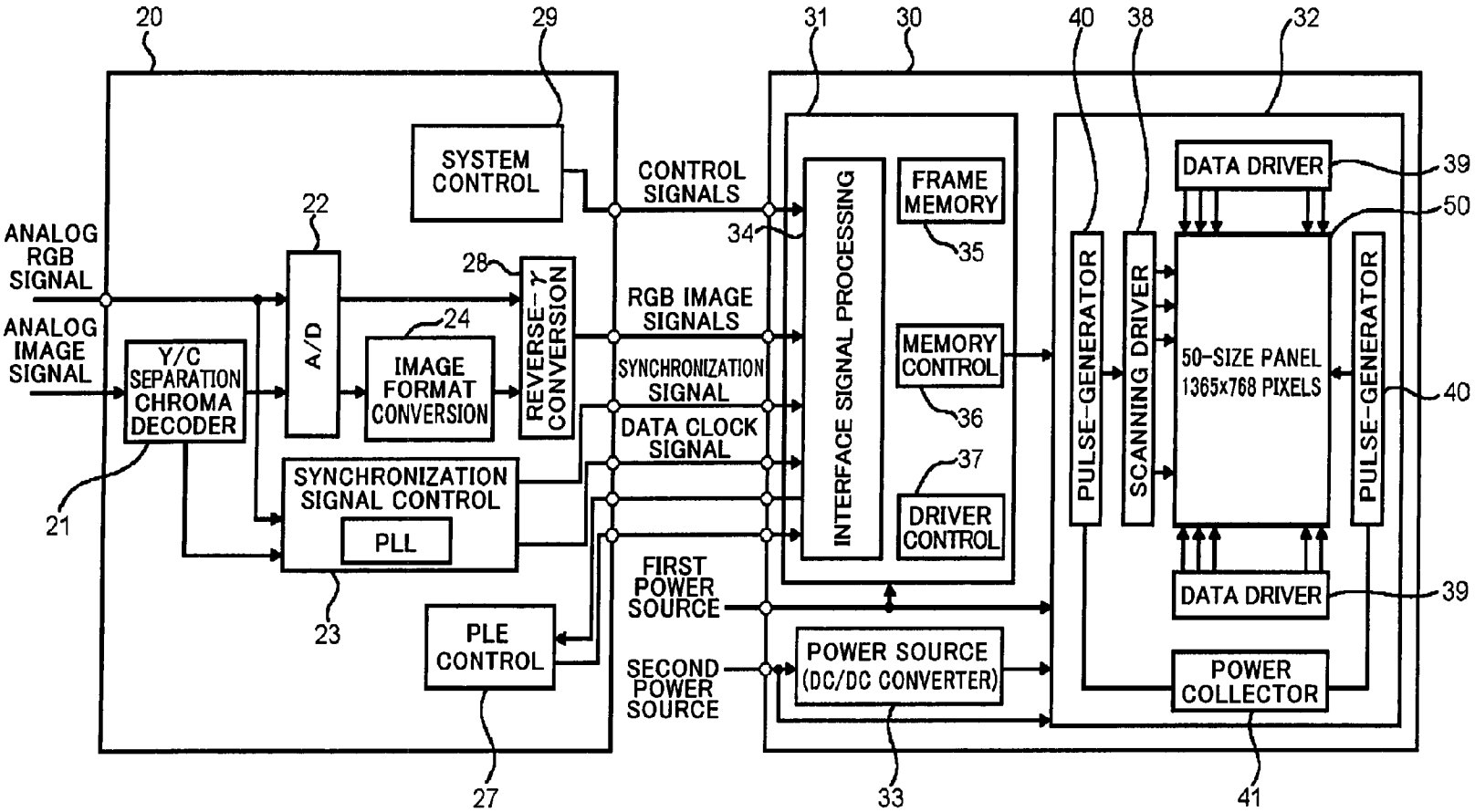
FIG. 10 is a block diagram of a plasma display apparatus including the plasma display panel in accordance with the present invention.

The fifth embodiment of the present invention relates to a plasma display apparatus. FIG. 10 is a block diagram of a plasma display apparatus 10 including the plasma display panel in accordance with any one of the above-mentioned embodiments.

As illustrated in FIG. 10, the plasma display apparatus 10 is comprised of an analog interface 20 and a plasma display module 30.

The analog interface 20 is comprised of a Y/C separating circuit 21 including a chroma-decoder, an analog-digital (A/D) converting circuit 22, a circuit 23 for controlling a synchronization signal, including a phase-lock loop (PLL) circuit, a circuit 24 for converting an image format, a PLE control circuit 27, an reverse-gamma converting circuit 28, and a system control circuit 29.

In brief, the analog interface 20 coverts a received analog image signal into a digital image signal, and then, outputs the digital image signal to the plasma display module 30.

For instance, an analog image signal transmitted from a television tuner (not illustrated) is separated into luminance signals for RGB colors in the Y/C separating circuit 21, and then, converted into a digital signal in the A/D converting circuit 22.

Then, if a pixel configuration in the plasma display module 30 is different from a pixel configuration of the image signal, necessary conversion is carried out in the image-format converting circuit 24.

A characteristic of a luminance to a signal input to a plasma display panel is linear. Image signals are usually compensated for, specifically, gamma-converted in advance in accordance with characteristics of a cathode ray tube (CRT). Hence, after the image signals are A/D-converted in the A/D converting circuit 22, reverse-gamma conversion is applied to the image signals are in the reverse-gamma converting circuit 28 for producing digital image signals having linear characteristics. The digital image signals are output to the plasma display module 30 as RGB image signals.

Since an analog image signal does not include a sampling clock signal and a data clock signal used for A/D conversion, the PLL circuit included in the control circuit 23 produces a sampling clock signal and a data clock signal, based on a horizontal synchronization signal provided together with the analog image signal, and outputs the clock signals to the plasma display module 30.

The PLE control circuit 27 carries out luminance control. Specifically, if an average picture level is equal to or smaller than a threshold level, a luminance for displayed images is raised, and if an average picture level is greater than a threshold level, a luminance is reduced.

The system control circuit 29 outputs various control signals to the plasma display module 30.

The plasma display module 30 is comprised of a digital signal processing and controlling circuit 31, a panel section 32, and a power source circuit 33 including a DC/DC converter.

The digital signal processing and controlling circuit 31 is comprised of an interface signal processing circuit 34, a frame memory 35, a memory control circuit 36, and a driver control circuit 37.

The interface signal processing circuit 34 receives various control signals transmitted from the system control circuit 29, an RGB image signal transmitted from the reverse-gamma converting circuit 28, a synchronization signal transmitted from the control circuit 23, and a data clock signal transmitted from the PLL circuit.

For instance, an average picture level (APL) of an image signal input into the interface signal processing circuit 34 is calculated in an APL calculating circuit (not illustrated) included in the interface signal processing circuit 34, and output as 5-bit data, for instance. The PLE control circuit 27 arranges PLE control data in accordance with the calculated average picture level, and outputs the PLE control data to a picture level control circuit (not illustrated) included in the interface signal processing circuit 34.

The digital signal processing and controlling circuit 31 processes those signals in the interface signal processing circuit 34, and then, transmits a control signal to the panel section 32.

The panel section 32 is comprised of a 50-size plasma display panel in accordance with one of the first to fourth embodiments, a scanning driver 38 for driving a scanning electrode, data drivers 39 for driving data electrodes, pulse-generating circuits 40 for applying a pulse voltage to the plasma display panel 50 and the scanning driver 38, and a circuit 41 for collecting excess power from the pulse-generating circuits 40.

In the plasma display panel 50, the scanning driver 38 controls a scanning electrode, and the data drivers 39 control data electrodes, thereby a light is emitted from selected display cells for displaying images.

A first power source supplies power to the digital signal processing and controlling circuit 31 and the panel section 32. A power source circuit 33 receives DC power from a second power source, converts a DC voltage into a desired voltage, and supplies the desired voltage to the panel section 32.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Applications Nos. 2002-225890 and 2003-282649 filed on Aug. 2, 2002 and Jul. 30, 2003 including specification, claims, drawings and summary is incorporated herein by reference in its entirety.

What is claimed is:

1. A plasma display panel comprising:

(a) a first substrate;

(b) a second substrate spaced away from and facing said first substrate;

(c) at least one scanning electrode formed on a surface of said first substrate which surface faces said second substrate, and extending in a first direction;

(d) at least one sustaining electrode formed on said surface of said first substrate and extending in parallel with said scanning electrode;

(e) a dielectric layer formed on said first substrate, covering said scanning and sustaining electrodes therewith; and (f) at least one data electrode formed on a surface of said second substrate which surface faces said first substrate, and extending in a second direction perpendicular to said first direction, display cells being arranged at intersections of said scanning and sustaining electrodes and said data electrode, each of said scanning and sustaining electrodes being comprised of a transparent electrode, said dielectric layer being comprised of a transparent dielectric layer, said dielectric layer having a high-capacity portion having a capacity higher than that of the rest of said dielectric layer, said high-capacity portion being spaced away from a discharge gap and extending in said first direction, each of said scanning and sustaining electrodes being formed with an opening between said discharge gap and said high-capacity portion.

2. The plasma display panel as set forth in claim 1, wherein each of said scanning and sustaining electrodes is formed with a second opening at an opposite side of said discharge gap about said high-capacity portion.

3. The plasma display panel as set forth in claim 2, wherein said opening and said second opening are substantially identical in shape to each other.

4. The plasma display panel as set forth in claim 1, wherein said high-capacity portion has a thickness smaller than a thickness of the rest of said dielectric film.

5. The plasma display panel as set forth in claim 4, wherein said scanning and sustaining electrodes are formed separately in each of said display cells, and are electrically connected to one another, respectively, through a bus electrode extending in said first direction, and said high-capacity portion is formed above said bus electrode.

6. The plasma display panel as set forth in claim 5, wherein said bus electrode has a width smaller than a width of said scanning and sustaining electrodes.

7. The plasma display panel as set forth in claim 5, wherein said bus electrode passes a center of said scanning and sustaining electrodes in said second direction.

8. The plasma display panel as set forth in claim 5, wherein said bus electrode is located at a distance in the range of 120 $\mu$m and 300 $\mu$m both inclusive from a centerline of said discharge gap.

9. The plasma display panel as set forth in claim 5, wherein said opening is located in symmetry with said second opening about said bus electrode.

10. The plasma display panel as set forth in claim 1, wherein said high-capacity portion is comprised of a dielectric layer having a dielectric constant higher than that of the rest of said dielectric layer.

11. The plasma display panel as set forth in claim 10, wherein said scanning and sustaining electrodes are formed separately in each of said display cells, and are electrically connected to one another, respectively, through a bus electrode extending in said first direction above ends of said scanning and sustaining electrodes which end is located remote from said discharge gap.

12. The plasma display panel as set forth in claim 1, wherein said scanning and sustaining electrodes are connected to each other, respectively, across adjacent display cells in said first direction.

13. The plasma display panel as set forth in claim 1, wherein said opening has a shape of a rectangle having sides each having a length equal to or greater than 50 $\mu$m.

14. The plasma display panel as set forth in claim 1, wherein said second opening has a shape of a rectangle having sides each having a length equal to or greater than 50 $\mu$m.

15. The plasma display panel as set forth in claim 1, wherein said scanning and sustaining electrodes are formed separately in each of said display cells, and are electrically connected to one another, respectively, through a bus electrode, said bus electrode comprising a first bus electrode formed above said high-capacity portion and extending in said first direction, and a second bus electrode extending in said first direction above ends of said scanning and sustaining electrodes which end is located remote from said discharge gap.

16. The plasma display panel as set forth in claim 1, wherein said high-capacity portion passes centers of said scanning and sustaining electrodes in said second direction.

17. The plasma display panel as set forth in claim 1, wherein a drive voltage increasing with the lapse of time is applied to said scanning electrode in a priming period in which a serrate priming pulse which is positive relative to said sustaining electrode is applied to said scanning electrode, and a serrate priming pulse negative relative to said scanning electrode is applied to said sustaining electrode.

18. The plasma display panel as set forth in claim 1, wherein said plasma display panel is driven in a drive sequence including, in an order, (a) a priming period in which a voltage of said scanning electrode is raised by means of a pulse having a ramp waveform positive relative to said sustaining and data electrodes, said voltage is lowered by means of a pulse having a ramp waveform negative relative to said sustaining and data electrodes after said voltage is stopped being raised, and a voltage of said sustaining electrode is raised in such a manner that a voltage of said sustaining electrode is positive relative to a voltage of said scanning electrode while said voltage is being lowered, (b) an address period in which whether a light is emitted or not for each of said display cells, and (c) a sustaining discharge period in which a luminance is determined.

19. A plasma display apparatus comprising:

an analog interface which converts a received analog image signal into a digital image signal, and outputs the thus converted digital image signal; and a plasma display module which includes a plasma display panel, and outputs images in accordance with said digital image signal received from said analog interface, said plasma display panel including:

(a) a first substrate;

(b) a second substrate spaced away from and facing said first substrate;

(c) at least one scanning electrode formed on a surface of said first substrate which surface faces said second substrate, and extending in a first direction;

(d) at least one sustaining electrode formed on said surface of said first substrate and extending in parallel with said scanning electrode;

(e) a dielectric layer formed on said first substrate, covering said scanning and sustaining electrodes therewith; and (f) at least one data electrode formed on a surface of said second substrate which surface faces said first substrate, and extending in a second direction perpendicular to said first direction, display cells being arranged at intersections of said scanning and sustaining electrodes and said data electrode, each of said scanning and sustaining electrodes being comprised of a transparent electrode, said dielectric layer being comprised of a transparent dielectric layer, said dielectric layer having a high-capacity portion having a capacity higher than that of the rest of said dielectric layer, said high-capacity portion being spaced away from a discharge gap and extending in said first direction, each of said scanning and sustaining electrodes being formed with an opening between said discharge gap and said high-capacity portion.

* * * * *